US008469631B2

(12) United States Patent
Santi

(10) Patent No.: US 8,469,631 B2
(45) Date of Patent: Jun. 25, 2013

(54) MODULAR AND EASY TO ASSEMBLE GRILLED COVER PIECE FOR DRAINAGE CHANNELS

(75) Inventor: Emiliano Santi, Serravalle (SM)

(73) Assignee: EUR.EX S.r.l., Serravalle (SM)

( * ) Notice: Subject to any disclaimer, the term of this patent is extended or adjusted under 35 U.S.C. 154(b) by 138 days.

(21) Appl. No.: 13/051,594

(22) Filed: Mar. 18, 2011

(65) Prior Publication Data

US 2011/0236133 A1 Sep. 29, 2011

(30) Foreign Application Priority Data

Mar. 24, 2010 (IT) ..... BO20100028 U

(51) Int. Cl.
*E02B 11/00* (2006.01)

(52) U.S. Cl.
USPC ..... 405/43; 405/50; 405/118; 404/4; 210/164

(58) Field of Classification Search
USPC ..... 405/118, 119, 43, 44, 45, 47, 50, 405/36; 404/2, 4; 210/163, 164
See application file for complete search history.

(56) References Cited

U.S. PATENT DOCUMENTS

| | | | | |
|---|---|---|---|---|
| 2,436,593 | A * | 2/1948 | Moselowitz | 404/4 |
| 4,490,067 | A * | 12/1984 | Dahowski | 405/43 |
| 5,380,121 | A * | 1/1995 | Schluter | 210/164 |
| 5,564,857 | A * | 10/1996 | Schluter | 210/164 |
| 6,000,881 | A | 12/1999 | Becker et al. | |
| 6,113,311 | A * | 9/2000 | Becker et al. | 405/119 |
| 6,663,317 | B1 * | 12/2003 | Williams et al. | 405/48 |
| 6,746,179 | B1 * | 6/2004 | Kerkhoff | 405/43 |
| 6,905,285 | B2 * | 6/2005 | Little et al. | 405/118 |
| 7,008,137 | B2 * | 3/2006 | Muller | 404/4 |
| 7,264,418 | B1 * | 9/2007 | Houck et al. | 405/43 |
| 7,588,392 | B2 * | 9/2009 | Wroblewski et al. | 405/118 |

FOREIGN PATENT DOCUMENTS

| | | | |
|---|---|---|---|
| DE | 20318130 | U1 | 3/2004 |
| DE | 102004055843 | A1 | 6/2005 |
| DE | 202006007527 | U1 | 9/2006 |
| EP | 1870519 | A2 | 12/2007 |
| GB | 2261242 | A | 12/1993 |
| GB | 2448664 | A | 10/2008 |
| WO | 01/94704 | A1 | 12/2001 |

OTHER PUBLICATIONS

European Search Report dated Jul. 5, 2011 in corresponding European Patent Application No. 11159155.8, 3 pages.

* cited by examiner

*Primary Examiner* — Frederick L Lagman
(74) *Attorney, Agent, or Firm* — Stites & Harbison PLLC; Marvin Petry

(57) ABSTRACT

The grilled cover piece for drainage channels has a substantially horizontal wall covering the channel and a longitudinal hollow ridge which extends upwards with its top wall having eyelets or holes. The cover piece is positioned flush with or just below the level of the surface from which the water to be drained must be removed, wherein the water flows down by means of gravity into the underlying channel which conveys the water away. The cover piece is provided transversely at one end with at least one female profile and at its other end with at least one male profile complementing the female profile, so that it is possible to connect and fix together several cover pieces arranged in succession so as to cover the channel along the entire length.

7 Claims, 2 Drawing Sheets

MODULAR AND EASY TO ASSEMBLE GRILLED COVER PIECE FOR DRAINAGE CHANNELS

RELATED APPLICATIONS

This application is the U.S. national stage application which claims priority under 35 U.S.C. §119, to Italian Patent Application No.: B02010U000028, filed on Mar. 24, 2010, the disclosure of which is incorporated by reference herein its entirety.

The present invention relates to drainage channels, in particular of the type made of plastic, for example as described in European application No. 07110549.8 (publication No. EP 1 870 519) and, with regard to these channels or similar or equivalent channels, relates to a grilled cover piece of the modular and easy-to-assemble type which may be adapted precisely to the entire length of said drainage channels. In particular, the cover piece in question is of the type which allows arrangement of the drainage channel in the depth of the ground and which comprises a horizontal part for covering the channel, provided with a longitudinal top projection which emerges flush with or just below the level of the surface from which the water must be removed, having a small grilled mouth into which the water to be drained enters, said water flowing down by means of gravity into the channel and being channelled and conveyed away by the latter. Such a cover piece is in turn incorporated in the ground so that it is mechanically protected by the ground itself and has a limited impact from an aesthetic point of view. Grilled cover pieces of the aforementioned type are known, for example, from U.S. Pat. No. 7,008,137 entitled "Cover piece for a drainage channel" and also British patent application GB 2,261,242 entitled: "Drainage channel and cover therefor". In all these prior art documents which illustrate grilled cover pieces for channels, it is not described or suggested how to produce these cover pieces with the characteristics of being modular and easy to assemble, such that these same cover pieces may be adapted to different lengths of the channels to be covered. The invention aims to overcome these drawbacks of the prior art with a grilled cover piece for drainage channels, the characteristic features and advantages of which will become clear from the following description provided with reference to the figures in the two accompanying drawings in which:

Figure 1:
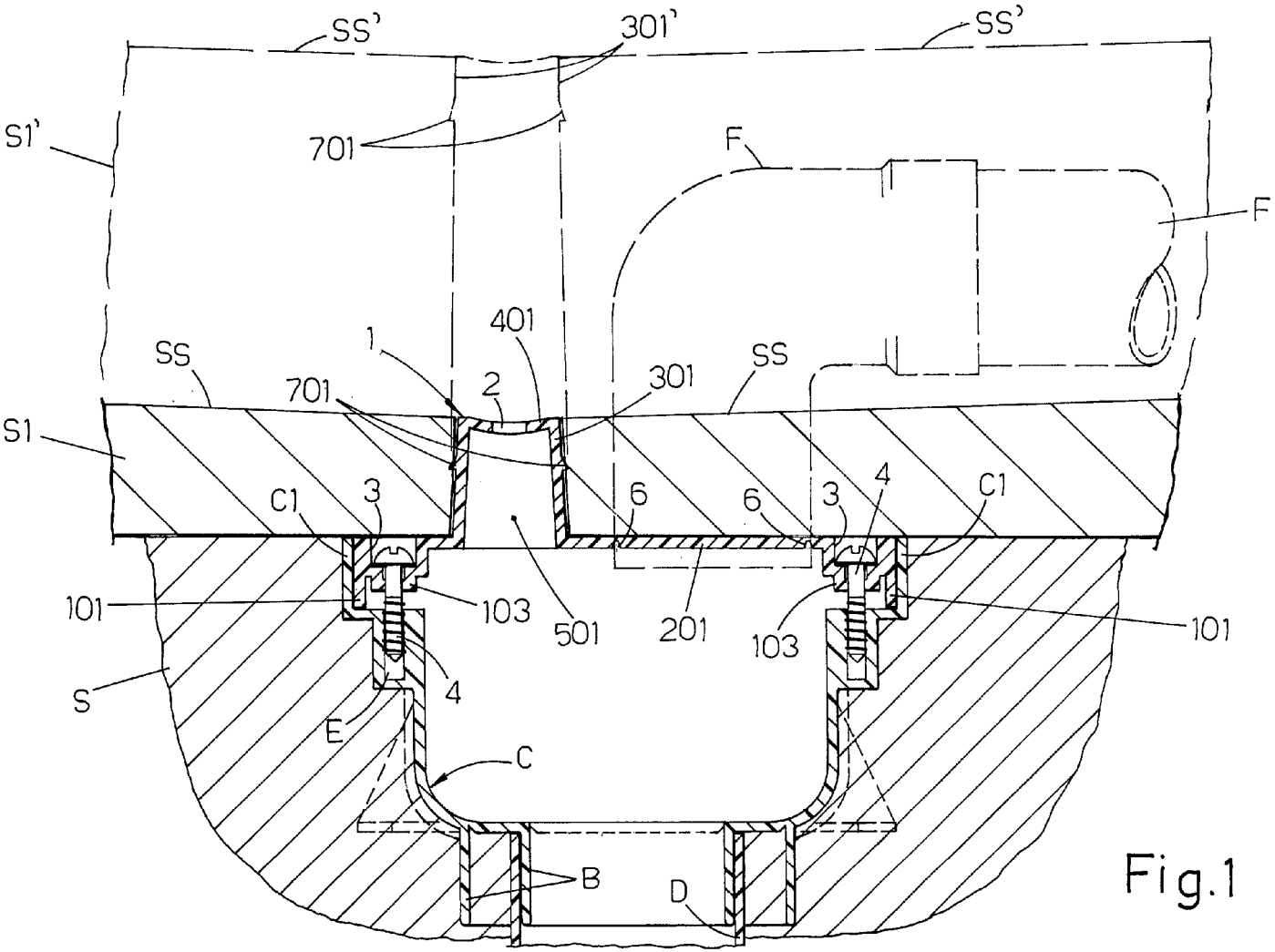
FIG. 1 shows a cross-section of a drainage channel with a cover piece according to the invention.

In FIG. 1, C denotes the channel—made of plastic or other suitable material—which is anchored and incorporated in the deep ground S and which may be provided at the bottom with drainage openings B of different diameter and with pre-weakened partitions for easy opening and for engagement with drainage ducts D and which has a widened top mouth, with side walls C1 usually with right-angled profiling which receive the downwardly directed side flanges 101 of the cover piece 1 according to the invention which is also made of plastic and/or other suitable material, having dimensions matching those of the channel to be covered with its flat wall 201 which is provided with a longitudinal hollow ridge 301 which extends upwards and which has a cross-section widened towards the bottom in order to facilitate removal from the mould of the mould part forming it. The top wall 401 of the ridge 301 is concave and has a succession of eyelets or through-holes 2 which are spaced from each other at a suitable interval. The ridge 301 is usually positioned asymmetrically as shown in the drawings, but it is understood that it may be positioned symmetrically with respect to the side flanges 101 of the cover piece 1. The ridge 301 is embedded in the top finishing part S1 of the ground, which preferably has a top surface SS, SS' formed so as to slope towards the top non-projecting wall 401 of said ridge 301, so that the water to be drained is conveyed by means of gravity from said surface SS, towards the top grilled surface 401 of the cover piece 1, where it passes through the openings 2 and falls into the channel C which conveys it away. The ridge 301 may be made with different heightwise dimensions, as indicated for example in broken lines and by 301' in FIG. 1, or with intermediate heights, so as to be suitable for different conditions of use. Purely by way of a non-limiting example, the ridges 301, 301' may be made with heights of 20, 90 and 140 mm. Usually the cover 1 with the low-height ridge 301 is used in channels located inside houses and buildings, while the covers 1' with the maximum or medium height ridge 301' are used in the drainage channels for floors and other surfaces which are usually external.

The ridge 301 is closed at the ends by walls 501 and is reinforced by internal partitions 601 which for example extend along the entire height of said ridge 301 and which are spaced from each other at a suitable interval, as will be explained further below. The covering wall 201 of the piece 1, 1' has, at a short distance from the side flanges 101, recessed impressions 3 in the form of eyelets to which an associated raised part 103 on the bottom side of the same wall 201 corresponds, these impressions being oriented with their greater dimension in the direction of the length of the piece 1, and their bottom being weakened by a perimetral incision so as to be easily removed and allow the insertion of screws 4 which are fixed inside corresponding seats E usually provided on the sides of the channel C, with a mutual spacing matching that of said impressions 3 inside which the screws 4 are intended to be received with their heads. It is understood that, as an alternative to fixing with the screws 4, the cover piece 1 may be fixed to the channel C using glue.

Figure 3:
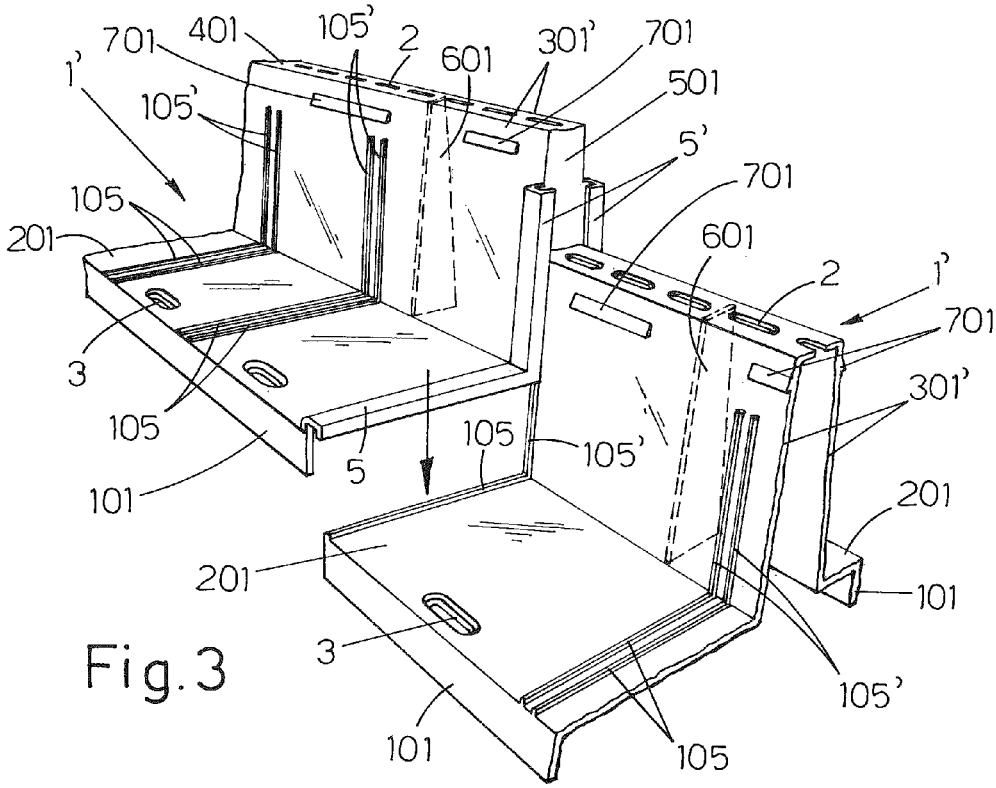
FIGS. 2 and 3 show a perspective view of two pairs of cover pieces with different characteristics, while being joined together.
Figure 2:
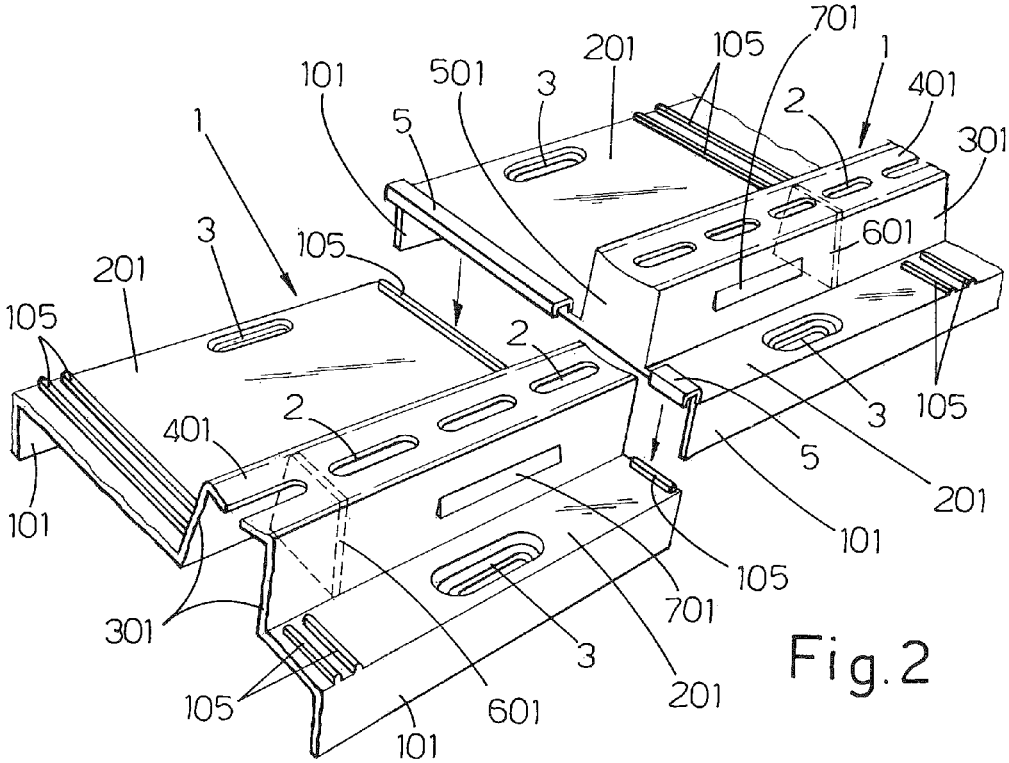

What characterizes most the cover pieces 1 according to the invention is the fact that these pieces 1, 1' are provided, transversely on one of their ends, with at least one female or grooved profile 5 which in the cover piece 1 with low ridge 301, as can be seen from FIG. 2, extends only along the covering wall 201, while in the piece 1' with higher ridge 301', as can be seen from FIG. 3, it extends along both the wall 201 as indicated by 5 and the near end of said ridge 301', at least over a part of its height, as indicated by 5'. The other end of the cover pieces 1 or 1' has at least one male or raised profile 105, 105' with a cross-section complementing the inner cross-section of the aforementioned female profile 5, 5', such that it is possible to connect and fasten together several cover pieces 1, 1' arranged in succession, so as to cover the channel C along its entire length.

The cover pieces according to the invention are preferably formed with a decimal length, for example of 500 mm, and have externally, at an interval of 100 mm from each other, intermediate pairs of said male profiles 105, 105' between which a transverse cut may be performed in order to shorten the cover piece by a decimal interval and adapt it to the different conditions of use, with the following double advantage:

a) the pair of said male profiles 105, 105' has a minimum distance between said profiles, such that said profiles act as a guide for the blade of a saw, such as a hacksaw, of the type usually used for these purposes, so as to allow a clean and perfectly square cut to be performed;

b) one of the two male profiles 105, 105' remains attached to the shortened cover piece and forms the end male profile 105, 105' suitable for co-operating with the female profile 5, 5' of the next cover piece.

From FIGS. 2 and 3 can be seen that the internal partitions 601 for reinforcing the ridge 301, 301' are arranged at an interval such as to be suitably spaced from said pairs of male profiles 105, 105' so as not to interfere with the saw during said cutting operation.

The cover piece 1, 1' according to the invention preferably has, for example, on the bottom side of the widest part of the covering wall 201, at least one circular recessed impression 6 (FIG. 1) of suitable diameter, for example 40 mm, thus creating a weakened zone for easy removal of the internal part of said impression, so as to form in the wall 201 a hole to which additional discharge pipes can be connected, as indicated by F and shown in broken lines in said FIG. 1.

Finally, from the figures it can be seen that the side surfaces of the ridge 301, 301' may be provided with downwardly splayed reliefs 701 useful for the product forming process, for example for facilitating extraction thereof from the forming mould, and useful also for fixing said ridge in the finishing material S1 of the ground in which the drainage channel with said cover piece (1, 1') according to the invention is installed.

The invention claimed is:

1. A grilled cover piece for drainage channels, comprising:

a substantially horizontal wall covering the channel and provided with a longitudinal hollow ridge which extends upwards and which with its top wall provided with eyelets or holes emerges flush with or just below the level of the surface from which the water to be drained must be removed, wherein the water flows down by gravity into the underlying channel where it is channelled and conveyed, the cover piece being provided, transversely at one end, with at least one female profile and at its other end, with at least one male profile complementing the female profile at the other end, so that several cover pieces can be connected together to be arranged in succession so as to cover the channel along its entire length.

2. The grilled cover piece according to claim 1, wherein the cover piece has a length of the decimal type, about equal to 500 mm and in that the cover piece is provided externally, at an interval of 100 mm from each other, with intermediate pairs of said male profiles between which a transverse cut may be performed in order to shorten the cover piece by a decimal interval and adapt it to the different conditions of use, and, the pair of said male profiles having a minimum distance between said profiles, such that said profiles act as a guide for the blade of a saw, so as to allow a clean and perfectly square cut to be performed; and wherein one of the two male profiles remains attached to the shortened cover piece and forms the end male profile suitable for co-operating with the female profile of the next cover piece.

3. The grilled cover piece according to claim 2, wherein said pairs of intermediate male profiles are arranged suitably staggered with respect to the arrangement of internal reinforcing partitions of the ridge, so that said partitions do not interfere with the saw during said cutting operations.

4. The grilled cover piece according to claim 1, wherein said covering wall has longitudinal side flanges which are directed downwards and which rest inside the right-angled side walls of the top mouth of the channel and along which said covering wall has recessed impressions in the form of an eyelet, which eyelets are oriented with their greater dimension in the direction of the length of the cover piece the bottom of the covering wall being weakened by a perimetral incision so as to be easily removed to allow the insertion of screws to be fixed inside corresponding seats on the sides of the channel, with a mutual spacing matching that of said impressions.

5. The grilled cover piece according to claim 3, wherein the side surfaces of the ridge have downwardly splayed reliefs useful for the product forming process, for facilitating extraction thereof from a forming mould, and for fixing said ridge in a finishing material of the ground in which the drainage channel with said cover piece is installed.

6. The grilled cover piece according to claim 1, wherein the cover piece is provided, on the bottom side of the widest part of the associated covering wall with at least one circular recessed impression of suitable diameter, which creates a weakened zone for easy removal of a part of said impression, so as to form a hole to which additional discharge pipes can be connected.

7. The grilled cover piece according to claim 1, wherein said covering wall has longitudinal side flanges which are directed downwards and which rest inside the right-angled side walls of the top mouth of the channel and along which said covering wall has recessed impressions, and wherein the cover piece is attached to the channel by glue.

* * * * *